US007169025B2

(12) United States Patent
Schumacher

(10) Patent No.: US 7,169,025 B2
(45) Date of Patent: Jan. 30, 2007

(54) GRINDING TOOL FOR A GRINDER WITH ROTARY OSCILLATING DRIVE

(75) Inventor: Hermann Schumacher, Reutlingen (DE)

(73) Assignee: C. & E. Fein GmbH (DE)

( * ) Notice: Subject to any disclaimer, the term of this patent is extended or adjusted under 35 U.S.C. 154(b) by 0 days.

(21) Appl. No.: 11/213,045

(22) Filed: Aug. 26, 2005

(65) Prior Publication Data

US 2006/0030249 A1 Feb. 9, 2006

Related U.S. Application Data

(63) Continuation of application No. PCT/EP03/14278, filed on Dec. 16, 2003.

(30) Foreign Application Priority Data

Feb. 27, 2003 (DE) ..... 103 08 600

(51) Int. Cl.
*B24B 7/00* (2006.01)
*B24B 23/00* (2006.01)
*B24B 27/08* (2006.01)

(52) U.S. Cl. ..... 451/163; 451/168; 451/356; 451/357; 451/490; 451/502; 451/513; 451/517; 451/519; 451/520; 451/524

(58) Field of Classification Search ..... 451/162, 451/163, 164, 165, 168, 344, 354, 356, 357, 451/490, 502, 513, 514, 517, 518, 519, 520, 451/499, 523, 524
See application file for complete search history.

(56) References Cited

U.S. PATENT DOCUMENTS 570,456 A * 11/1896 Collins ..... 451/517
3,034,267 A 5/1962 Feeney ..... 51/187
3,842,849 A * 10/1974 Goodman ..... 132/273
3,967,417 A 7/1976 Jurak ..... 51/170 TL
4,920,702 A * 5/1990 Kloss et al. ..... 451/294
5,643,063 A * 7/1997 Uzumcu et al. ..... 451/356
5,643,663 A 7/1997 Bommier et al. ..... 428/317.9
5,749,770 A * 5/1998 Uzumcu et al. ..... 451/28
5,842,278 A 12/1998 Gmeilbauer ..... 30/277.4

(Continued)

FOREIGN PATENT DOCUMENTS

DE 88 17 233 U1 2/1995

(Continued)

OTHER PUBLICATIONS

International Search Report, Apr. 8, 2004, 3 pages.

*Primary Examiner*—Timothy V. Eley
(74) *Attorney, Agent, or Firm*—St. Onge Steward Johnston & Reens LLC

(57) ABSTRACT

Disclosed is a grinding tool for a grinder comprising a rotary oscillating drive, the output shaft of which is driven so as to oscillate back and forth about its longitudinal axis and is configured for securing the grinding tool thereon. The grinding tool comprises a grinding pad which is made of a resilient material and encompasses at least one grinding surface that runs straight in one direction of extension and parallel to a tangent to the output shaft of the rotary oscillating drive.

13 Claims, 3 Drawing Sheets

U.S. PATENT DOCUMENTS 6,379,236 B1 * 4/2002 Takizawa et al. ..... 451/490
6,659,851 B2 * 12/2003 Takahashi et al. ..... 451/356

FOREIGN PATENT DOCUMENTS

DE 195 31 270 C2 5/1996
DE 296 07 906 U1 10/1997
DE 197 17 563 A1 1/1998
DE 196 45 734 A1 2/1998
EP 0 244 465 11/1987
EP 0 726 121 A2 8/1996
EP 1 013 376 A2 6/2000
EP 1 252 972 A1 10/2002
GB 2 312 637 A 11/1997

* cited by examiner

GRINDING TOOL FOR A GRINDER WITH ROTARY OSCILLATING DRIVE

RELATED APPLICATIONS

This application is a continuation application of co-pending International Patent Application PCT/EP2003/014278 filed on Dec. 16, 2003 which designates the United States and claims priority of German patent application 103 08 600.5 filed on Feb. 27, 2003 and being fully incorporated by reference herewith.

BACKGROUND OF THE INVENTION

The invention relates to a grinding tool for a grinder comprising a rotary oscillating drive, the output shaft of which is oscillatingly driven about its longitudinal axis and comprises a support for mounting the grinding tool thereon, wherein the grinding tool comprises a receptacle configured for connecting with the support of the grinder for grinding in an operating position.

Such a grinder is known from EP-B-0 244 465.

The known grinder comprisese a rotary oscillating drive the output shaft of which is oscillatingly driven about its longitudinal axis at high frequency and with a small pivot angle. To the output shaft of the oscillating drive a grinding tool usually having triangular or rectangular space surface is secured, whereon a grinding surface is provided which extends within a plane perpendicular to the longitudinal axis of the output shaft. A sanding paper or the like may be fixed on the grinding tool by means of a Velcro tape by means of a clamping fixture and may also surround the front face of the grinding tool.

The grinder may advantageously be worked into corner regions when using a triangular grinding surface. The curvature of the grinder tool allows the front face to effectively work along a straight edge.

However, in some cases a grinding of longitudinal profiles is desired, wherein the grinding motion shall be performed mainly in a longitudinal direction.

For such a grinding the known grinder is not suitable.

From EP-A-0 726 121 a grinder comprising a grinding tool extending straight is known. However this grinding tool is not driven rotatingly oscillating about a fixed output shaft, but is oscillated back and forth in a longitudinal direction. Thus, the different profiles can be moved back and forth like in a manual operation of a grinding pad.

SUMMARY OF THE INVENTION

Thus it is a first object of the invention to disclose a grinder having a rotating oscillatory drive which allows for a grinding along longitudinal edges with only little vibrations.

It is a second object of the invention to disclose a grinder having a rotating oscillatory drive which allows for a grinding of profiles and the like.

It is a third object of the invention to disclose a grinder having a rotating oscillatory drive which allows for a grinding along longitudinal edges with a high removal rate.

It is a fourth object of the invention to disclose a grinding tool for a grinder having a rotating oscillatory drive which allows for a grinding along longitudinal edges with only little vibrations.

These and other objects of the invention are achieved with a grinding tool as mentioned at the outset in that the grinding tool comprises an elastic grinding pad having at least one grinding surface which extends straight in one direction and parallel to a tangent to the mounting opening of the output shaft of the oscillating drive and further extends at an angle to a plane defined by the securing section of the grinding tool.

Thus the object of the invention is completely achieved.

Namely, according to the invention it is now made possible to grind using a grinding surface extending straight in one direction and parallel to a tangent of the output shaft of the oscillating drive.

By means of the elastic material of the grinding pad it is ensured herein that strong vibrations of the grinding tool are avoided, even in view of the fact that the grinding surface extends straight at least in one direction.

The elastic design of the grinding pad negates vibrations and pushes resulting from the straight design of the grinding surface. Thus with such a grinder numerous grinding operations along longitudinal profiles can be performed. Herein the cross-section of the grinding pad can be adapted to the particular shape of the surface profile to be ground. Thus, a higher removal rate up to 5-fold when compared with the prior art can be reached.

According to an advantageous development of the invention the grinding tool comprises securing means for securing a grinding means, in particular a sanding paper, to the grinding pad.

The respective grinding means may be replaced but the grinding pad itself does not need to be chanced in the short term.

According to another advantageous design of the invention the grinding pad is made of a rubber-elastic material.

In this way the necessary elasticity or yielding characteristic of the grinding pad can be reached in a particular advantageous way.

According to another design of the invention the grinding surface is bent in a second direction perpendicular to the first extending direction.

In this way the surface of the grinding pad can be matched to numerous profiles to be ground.

According to another advantageous design of the invention the grinding pad has a hollow cross-section.

In this way a particular advantageous elasticity or yielding characteristic of the grinding pad can be reached.

According to another design of the invention the grinding tool comprises a securing section having a receptacle for connecting with the support of the output shaft and being followed by a holding section within which the grinding pad is held.

Herein the receptacle is preferably configured as a mounting opening.

In this way the grinding tool can be directly attached to the output shaft of the oscillating drive with the receptacle or mounting opening, respectively, e.g. by using a screw.

According to an advantageous development of the invention the holding section tapers from the securing section toward the mounting section.

In this way a grinding pad having a greater length can be mounted on the output shaft.

According to another design of the invention the holding section comprises a recess within which the grinding pad is held with a holding section and from which the holding pad protrudes to the outside with a working section whereon the grinding surface is formed.

In this way a safe mounting and simple assembly on the grinding section is ensured.

According to another design of the invention on both sides of the holding section clamping means are provided for securing a sanding paper guided around the grinding pad by clamping.

According to an additional development of this design on each side of the holding section a pivot lever is mounted which is biased against the holding section.

Thus a sanding paper can be fixed to the grinding pad in a particularly simple and fast way.

According to another design of the invention two slots are provided within the holding section for receiving the ends of a sanding paper guided around the grinding pad.

According to an additional development of this design at least one clamp is insertable into the holding section for securing a sanding paper guided around the grinding pad.

Also when using such a design, a simple and fast attachment of a sanding paper to the grinding pad can be reached. Since herein no pivot levers are necessary, by contrast only a clamp serving for securing the sanding paper, a particularly cost-effective design is reached.

According to an additional development of this design the at least one clamp is insertable with springable sections into insert openings on both sides of the holding section for bracing the sanding paper against the walls of the slots.

In this way a safe fixation of the sanding paper to the grinding pad is ensured.

According to a further design of the invention on both sides of the holding section a respective clamping lever is mounted pivotably and can be braced against the holding section in a clamping position for securing a sanding paper guided around the grinding pad.

In this way the clamping levers themselves may be used for bracing against the holding section so that the utilization of additional springs for generating the bracing force becomes superfluous. Simultaneously also the grinding pad is clamped in a simple way when biasing the clamping lever against the holding section.

As already mentioned above, the grinding tool can be used advantageously for grinding longitudinal profiles by means of a rotary oscillating drive the output shaft of which is oscillatingly driven about its longitudinal axis, wherein the grinding tool is mounted on the rotary oscillating drive, so that the at least one grinding surface extends tangentially to the output shaft.

It will be understood that the features of the invention mentioned above and to be explained hereinafter cannot be used only in the respective given combination, but also independently or in other combinations, without going beyond the scope of the invention.

BRIEF DESCRIPTION OF THE DRAWINGS

Further features and advantages of the invention can be taken from the following description with reference to the drawings. In the drawings show.

DETAILED DESCRIPTION OF THE PREFERRED EMBODIMENTS

Figure 1:
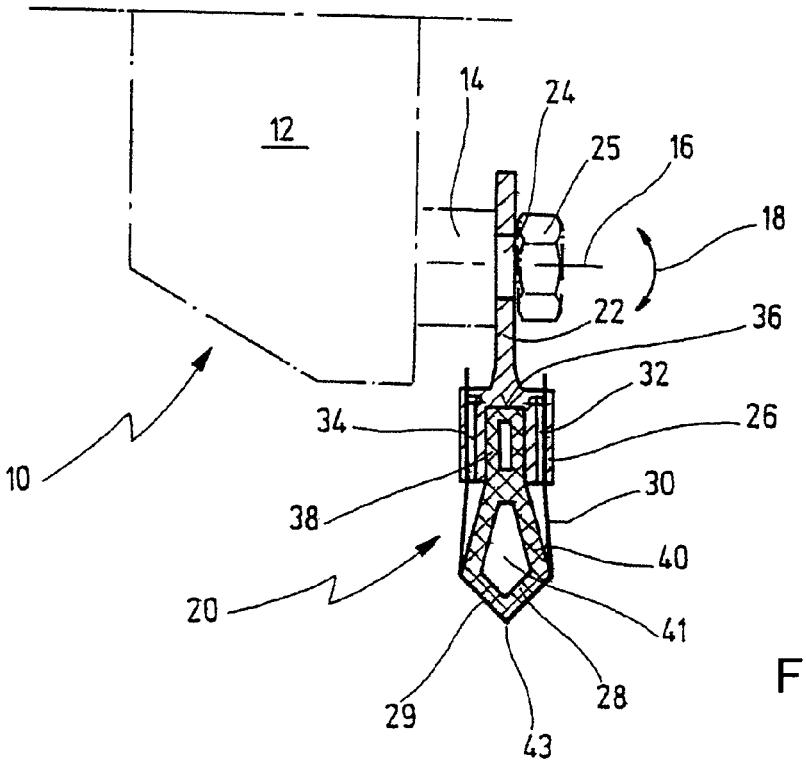
FIG. 1 a cross-section of a first embodiment of a grinder according to the invention, wherein an associated oscillatory drive, to which the grinding tool is affixed, is depicted schematically.

A first embodiment of the grinder according to the invention is shown in FIG. 1 and depicted in total with numeral 10. The grinder 10 comprises a rotary oscillating drive 12, merely depicted schematically with numeral 12, which oscillatingly drives an output shaft 14 about its longitudinal axis 16 with a small pivot angle between about 0.5 and 7° and at a high frequency between about 5000 and 25000 oscillations per minute (cf. double arrow 18).

On the output shaft 14 a support for mounting a grinding tool 20 is provided which, e.g., may be configured simply as a threaded blind hole by means of which the grinding tool 20 is affixed using a screw 25 extending through a mounting opening 24 of the grinding tool 20.

It will be understood that any kind of support may be provided for connecting the grinding tool 20 with the output shaft 14. For instance, also positively shaped supports may be used, such as by means of a hexagon or the like.

In FIG. 1 the grinding tool 20 is shown in a longitudinal section through the mounting opening 24.

Figure 2:
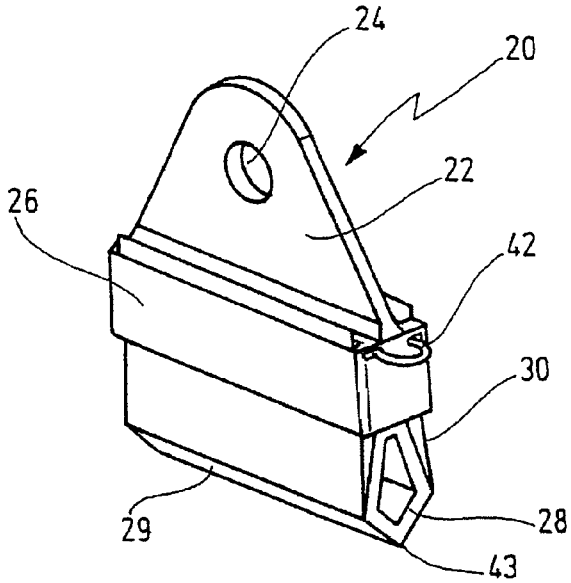
FIG. 2 a perspective view of the grinding tool according to FIG. 1, seen obliquely from one side.

The grinding tool 20 which can be seen in FIG. 2 in a perspective view obliquely from the front comprises a securing section 22 which is formed unitary with a holding section 26 which is shaped substantially cuboid. The securing section 22 is formed by a plate which tapers from the holding section 26 into the direction of the mounting opening 24, the plate extending around the mounting opening 24 substantially triangular with an angle of about 60° and being rounded thereabout in the region of the mounting opening 24. The holding section 26 extends in the extension of the securing section 22, however is enlarged with respect to the securing section 22 by a multitude, e.g. 5-fold. In the center of the holding section 26 a recess 36 shaped as a longitudinal slot is provided within which a grinding pad 28 is received with a holding section 38. The grinding pad 28 protrudes from the recess 36 to the outside with a working section 40.

The grinding pad 28 is made of a rubber-elastic material, such as of nitrile butadien rubber and is formed hollow-shaped with its working section 40 which protrudes from the holding section 26 to the outside, namely, is penetrated in the longitudinal direction by an opening 41. The grinding pad 28 which enlarges from its substantially cuboid shaped holding section 38 to the outside at both edges with an acute angle finally extends on both lateral edges, starting from a rim shaped in this way, toward a common tip 43 which encloses a corner angle of about 80 to 90°. In a direction perpendicular to the drawing plane of FIG. 1 the grinding pad 28 extends straight and is arranged tangentially to the longitudinal axis 16 of the drive shaft 14 of the oscillatory drive 12, when being in the shown working position.

Thus the grinding pad 28 moves tangentially to the drive shaft 14 when working with the oscillatory motion of the drive shaft 14.

Thus by means of the triangular shaped or roof-shaped outer surface of the grinding pad 28, which extends toward the tip 43, a grinding surface 29 is formed which is moved oscillatingly back and forth in the tangential direction of the drive shaft 14.

Figure 3:
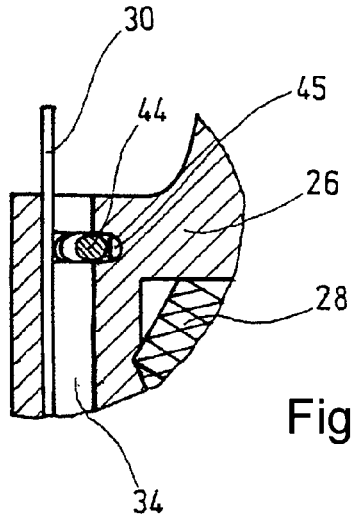
FIG. 3 an enlarged partial representation of the grinding tool according to FIG. 1, shown in the region of a clamp which serves for mounting the sanding paper.

While it would be basically possible to design the grinding surface 29 itself as a grinding means, e.g. by incorporating grinding particles or the like, it is preferred to guide a sanding paper or the like around the grinding surface 29 and to secure the sanding paper at its both ends to the holding section 26 of the grinding tool 20 removably. To this end in the holding section 26 two slots 32, 34 are provided which extend in parallel to the recess 36 shortly before the outer surface of the holding section 26 and which allow to guide both ends of the sanding paper 30 therethrough. A clamp 42 is provided for securing the sanding paper 30 at its both ends. The clamp 42 is basically U-shaped and can be inserted with its two legs into insert openings extending in parallel to the slots 32, 34. It can be seen from the enlarged representation of FIG. 3 that the respective leg 44 is designed corrugated and is held in the respective insert opening 45 for clamping the sanding paper 30 with its corrugated edges toward the outside against the wall of the respective slot 34.

In case the sanding paper 30 shall be exchanged, then merely the clamp 42 must be retracted to the outside. Then the sanding paper 30 can be removed and be replaced with a new piece of sanding paper. The two ends of which again are inserted through the slots 32, 34, and now the clamp 42 is again inserted with its two legs 44 into the respective insert openings to clamp the sanding paper 30 within the slots 32, 34 thereby.

It will be understood that the shape of the grinding pad 28 shown in FIGS. 1 and 2 is of merely exemplary nature and that the grinding pad may resemble any kind of profile shape, so that a grinding of longitudinal profiles is made possible with any desired shape.

Due to the yielding design of the grinding pad 28 herein a grinding with relatively small vibrations is made possible in an effective way, even in view of the grinding surface 29 which is planar in the longitudinal direction (tangential direction).

Figure 4:
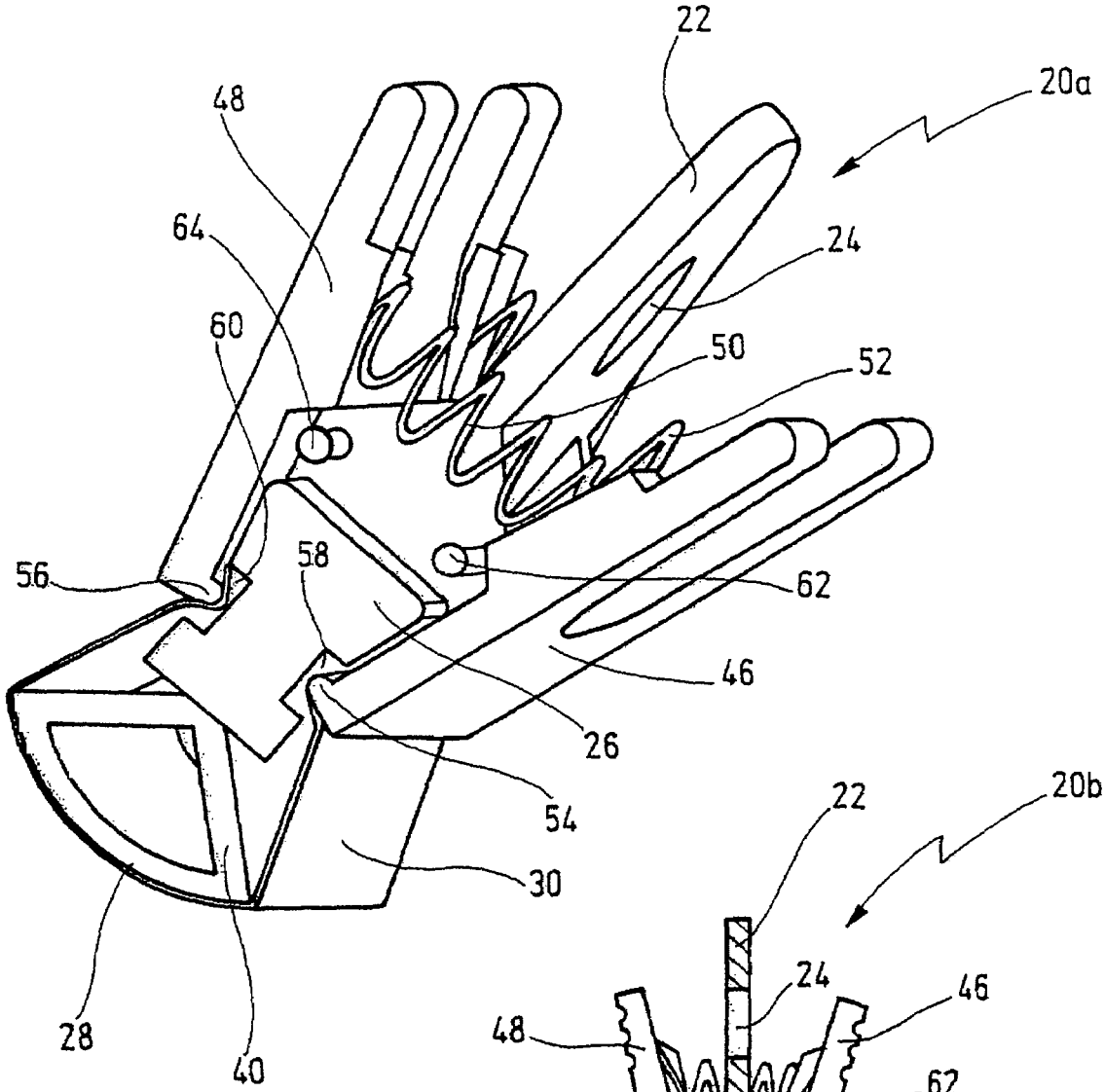
FIG. 4 a perspective representation of a different embodiment of a grinding tool according to the invention, seen obliquely from above.
Figure 5:
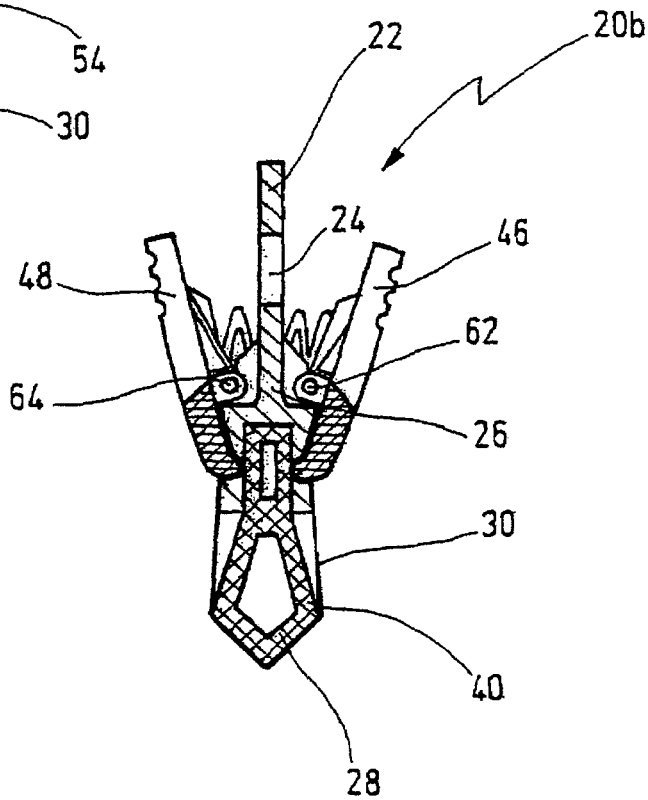
FIG. 5 a cross-sectional view of a slightly modified embodiment of the grinding tool according to FIG. 4, shown in reduced representation.
Figure 6:
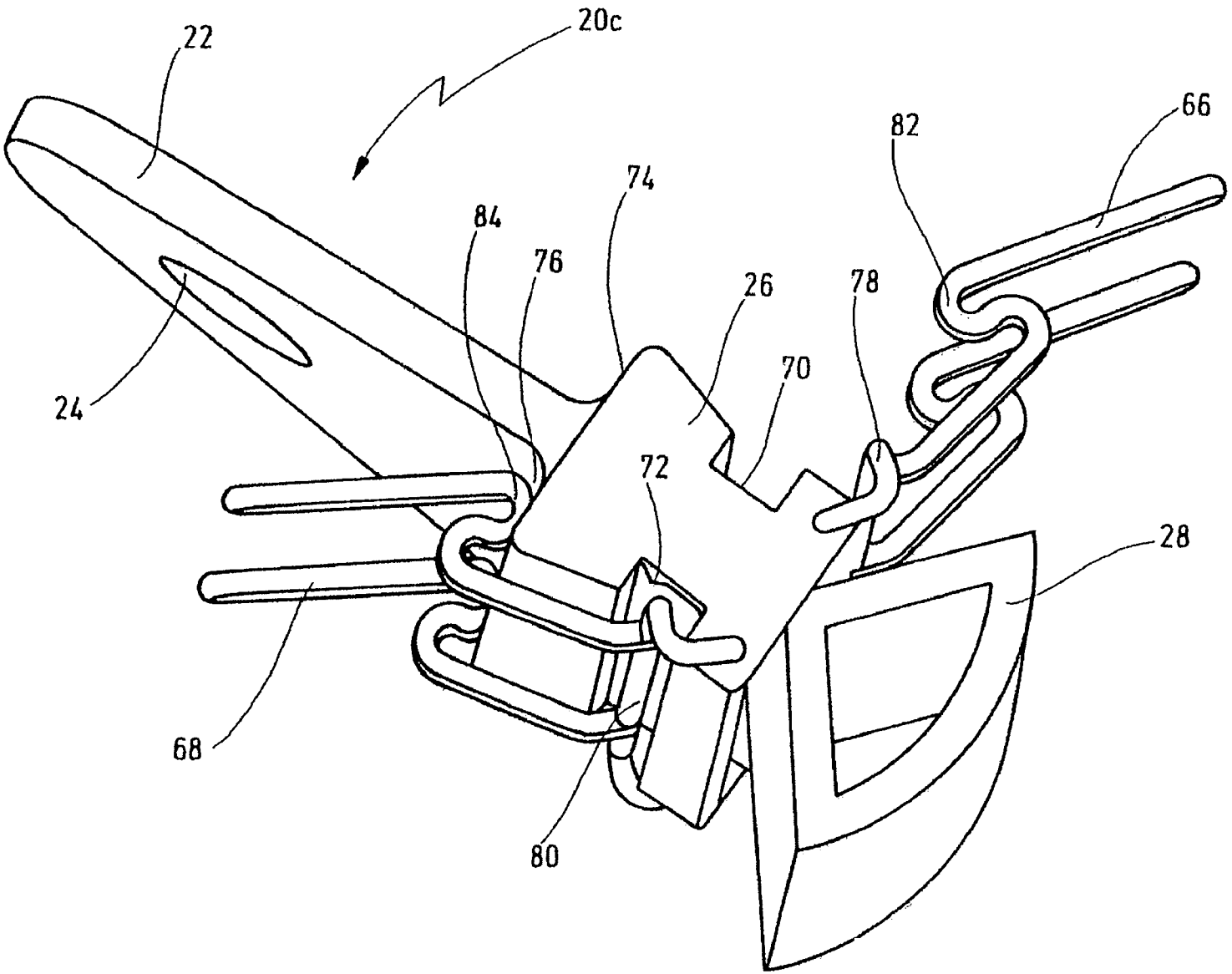
FIG. 6 a perspective view of a further embodiment of the grinding tool according to the invention, according to which two clamping levers are provided for clamping attachment of a sanding paper under the action of a spring force generated by the clamping levers themselves.

In FIGS. 4, 5 and 6, respectively, further embodiments of the grinding tool 20 are shown and depicted in total with numerals 20*a*, 20*b* and 20*c*. These differ from each other generally by using different receiving or mounting means, respectively, for mounting a sanding paper 30 on the grinding pad 28.

Herein corresponding reference numerals are used for corresponding parts.

In the grinding tool 20*a* according to FIG. 4, two pivot levers 46, 48 are used for securing the two ends of the sanding paper 30, the pivot levers being arranged pivotably about pivot axes 62, 64, and which are biased by springs 50, 52, respectively, arranged between the two pivot levers 46, 48. Thus the two ends of the sanding paper 30 are pressed into respective recesses 58, 60 or longitudinal grooves of the holding section 26 by means of protrusions 54, 56 of the pivot levers 46, 48 and are clamped by means of the spring tension.

The outer surface of the working section 40 of the grinding pad 28 differs in its shape from the form described above with reference to FIG. 1 in that it does not taper in an acute angle toward the outer end, but is formed with a sector of a circle. This grinding pad 28 is thus configured for grinding rounded longitudinal profiles.

In FIG. 5 an embodiment of the grinding tool, which is slightly modified with respect to the design according to FIG. 4, is shown in longitudinal section and depicted in total with numeral 20*b*.

Herein the design largely corresponds to the design according to FIG. 4. The only difference rests in the shape of the working section 40 of the grinding pad 28, the working section again fully corresponding to the shape previously described with reference to FIG. 1.

A further embodiment of a grinding tool according to the invention is shown in FIG. 6 and depicted in total with numeral 20*c*.

The shape of the grinding pad 28 again corresponds to the shape of the grinding pad 28 according to FIG. 4.

For securing the sanding paper which again is guided around the grinding pad 28, again two pivotable levers are provided which, however, are not under the action of springs, but can be clamped directly against steps 74, 76 of the holding section 26, due to its design as wire clamps, thus generating a clamping action without the use of additional springs. To this end in the holding section 26 recesses 70, 72 shaped as longitudinal grooves are provided on both sides allowing to insert the ends of a sanding paper. If the two clamping levers 66, 68 are closed thereafter, then they will be clamped at the end of the holding section 26 opposite the securing section 22 by means of its S-shaped holding sections 82, 84 against steps 74, 76. In this position in the direction of the recesses 70, 72 or of the longitudinal grooves, respectively, clamping sections 78, 80 of the clamping levers 66, 68 are biased by means of the tension of the clamping levers 66, 68 against the inner surface of the respective recesses 70, 72 or longitudinal grooves, respectively, thus clamping and securing the ends of a sanding paper thereto.

What is claimed is:

1. A grinding tool for a grinder having an oscillating drive, said oscillating drive having an output shaft which is oscillatingly driven about its longitudinal axis and comprises a support for mounting the grinding tool thereon, wherein said grinding tool comprises:

a securing section defining a plane and comprising a mounting opening which is configured for connecting with the support of the grinder;

a holding section extending from said securing section;

an elastic grinding pad being secured to said holding section and having at least one grinding surface which extends straight in one direction and parallel to a tangent to said mounting opening and at an angle to said plane defined by said securing section; and two slots provided within said holding section for receiving ends of a sanding paper guided around said grinding pad.

2. The grinding tool of claim 1, wherein said grinding surface is bent in a second direction which is perpendicular to said one direction.

3. The grinding tool of claim 1, further comprising a securing means for securing a grinding means to said grinding pad.

4. The grinding tool of claim 1, wherein said holding section comprises a recess within which said grinding pad is received.

5. The grinding tool of claim 4, wherein said securing section tapers from said holding section toward said mounting opening.

6. The grinding tool of claim 5, further comprising clamping means provided on both sides of said holding section for clamping a sanding paper guided around said grinding pad.

7. The grinding tool of claim 6, further comprising pivot levers provided on both sides of said holding section for clamping a sanding paper guided around said grinding pad, said pivot levers being biased against said holding section.

8. The grinding tool of claim 1, further comprising at least one clamp configured for insertion into said recess of said holding section for securing a sanding paper guided around said grinding pad.

9. The grinding tool of claim 1, further comprising two elastic clamps configured for insertion into insert openings provided on both sides of said recess for bracing the sanding paper against inner walls of said slots.

10. A grinding tool for a grinder having an oscillating drive, said oscillating drive having an output shaft which is oscillatingly driven about its longitudinal axis and comprises a support for mounting the grinding tool thereon, wherein said grinding tool comprises:

a securing section defining a plane and comprising a mounting opening which is configured for connecting with the support of the grinder;

an elastic grinding pad having at least one grinding surface which extends straight in one direction and parallel to a tangent to said mounting opening and at an angle to said plane defined by said securing section;

a holding section extending from said securing section into a direction opposite said mounting opening;

a recess formed within said holding section for receiving said grinding pad; and two clamping levers, a first one of which being arranged at a first outer side of said holding section, a second one of which being arranged at a second outer side of said holding section opposite said first outer side, said clamping levers being mounted pivotably and being configured for bracing against said holding section for fixing a sanding paper guided around said grinding pad.

11. A grinder comprising:

an oscillating drive having an output shaft which is oscillatingly driven about a longitudinal axis thereof, said output shaft comprising a support for mounting a grinding tool;

wherein said grinding tool comprises:

a securing section defining a plane and comprising a mounting opening which is configured for connecting with the support of the grinder;

an elastic grinding pad having at least one grinding surface which, extends straight in one direction and parallel to a tangent to said mounting opening and at an angle to said plane defined by said securing section;

wherein said grinding tool is secured to said output shaft of said oscillating drive such that said elastic grinding pad is rotated back and forth about said longitudinal axis when said oscillating drive is activated.

12. The grinder of claim 11, wherein said holding section comprises a recess within which said grinding pad is received, wherein said grinding pad protrudes beyond said recess exposing a working section whereon a grinding surface is formed.

13. A grinder comprising:

an oscillating drive having an output shaft which is oscillatingly driven about a longitudinal axis thereof, said output shaft comprising a support for mounting a grinding tool;

wherein said grinding tool comprises:

a securing section defining a plane and comprising a mounting opening which is configured for connecting with the support of the grinder;

an elastic grinding pad having at least one grinding surface which, extends straight in one direction and parallel to a tangent to said mounting opening and at an angle to said plane defined by said securing section; and two clamping levers, a first one of which being arranged at a first outer side of said holding section, a second one of which being arranged at a second outer side of said holding section opposite said first outer side, said clamping levers being mounted pivotably and being configured for bracing against said holding section for fixing a sanding paper guided around said grinding pad.

* * * * *